United States Patent [19]

Piörr et al.

[11] Patent Number: 4,612,142

[45] Date of Patent: Sep. 16, 1986

[54] ETHER SULFONATES AS LOW-FOAM WETTING AGENTS

[75] Inventors: Robert Piörr, Ratingen-Hoesel; Hildegard van Delden, Hilden; Sabine Lüttge, Monchen-Gladbach; Bernd Bähr, Neuss; Ingo Wegener, Duesseldorf, all of Fed. Rep. of Germany

[73] Assignee: Henkel Kommanditgesellschaft auf Aktien, Duesseldorf, Fed. Rep. of Germany

[21] Appl. No.: 772,827

[22] Filed: Sep. 5, 1985

[30] Foreign Application Priority Data

Sep. 13, 1984 [DE] Fed. Rep. of Germany ..... 3433593

[51] Int. Cl.[4] ..... C11D 1/28

[52] U.S. Cl. ..... 252/555; 252/89.1; 252/156; 252/549; 252/554; 260/513 R

[58] Field of Search ..... 252/549, 552, 554, 555, 252/530, 533, 535, 536, DIG. 4, 142, 156, 89.1; 260/513 R

[56] References Cited

U.S. PATENT DOCUMENTS 2,062,957 12/1936 Baldwin et al. ..... 260/513 R
3,592,796 7/1971 Trapasso et al. ..... 260/513 R
3,856,738 12/1974 Bodesheim et al. ..... 260/513 R
4,468,335 8/1984 Chen et al. ..... 260/513 R

FOREIGN PATENT DOCUMENTS 2724442 8/1977 Fed. Rep. of Germany .
1566770 5/1980 United Kingdom .

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

Ether sulfonates corresponding to the following general formula $$R^1—O(C_nH_{2n}O)_x—R^2—SO_3M \quad (I)$$

wherein $R^1$ is a $C_{1-6}$ alkyl, n is an integer of 2–4, x is an integer from 0–30, $R^2$ is a $C_{6-22}$ linear alkenylene, hydroxyalkylene or hydroxyalkenylene group, and M is hydrogen or an alkali metal cation, which can be obtained by sulfonation of olefinically unsaturated fatty alkyl lower alkyl ethers or fatty alkyl (polyoxyalkyl) lower alkyl ethers with sulfur trioxide and hydrolysis of the sultones formed, are particularly suitable for use as low-foam wetting agents in aqueous acidic or alkaline commercial-grade treatment preparations.

5 Claims, No Drawings

ETHER SULFONATES AS LOW-FOAM WETTING AGENTS

BACKGROUND OF THE INVENTION

1. Field of the Invention

This invention relates to treatment preparations containing ether sulfonates as low-foam wetting agents.

2. Description of Related Art

Numerous aqueous treatment preparations for the treatment of solid surfaces, for example fibers, fabrics, metals, ceramics or glass, are highly acidified or alkalized. Commercial-grade treatment preparations of this type, for example bleaches, mercerizing liquors, scouring, cleaning and degreasing agents, descaling agents, etching media, and pickling and derusting agents, require the addition of wetting agents to establish more rapid and intimate contact between the treatment preparation and the solid surface.

Wetting agents suitable for acidic and alkaline commercial-grade treatment preparations of the above type are required to show high solubility in water, even in acidic and alkaline media, and high stability to hydrolysis in those media. Since the above-mentioned treatment processes often involve vigorous mechanical agitation, undesirable foaming easily occurs. Accordingly, suitable wetting agents are required which generate very little foam. If this is not the case, antifoam agents have to be used. However, the use of antifoam agents not only involves additional costs, it often results in undesirable side effects, for example uneven treatment of the surface or the formation of hydrophobic residues on the treated surface.

In addition, commercial-grade wetting agents must be kind to the environment, i.e. are required to have good biodegradability and to be non-toxic to water organisms.

DESCRIPTION OF THE INVENTION

Other than in the operating examples, or where otherwise indicated, all numbers expressing quantities of ingredients or reaction conditions used herein are to be understood as modified in all instances by the term "about."

It has now been found that the above-mentioned requirements can be satisfied by using as wetting agents for aqueous, acidic and alkaline commercial-grade treatment preparations ether sulfonates corresponding to the following general formula $$R^1—O(C_nH_{2n}O)_x—R^2—SO_3M \quad (I)$$

in which $R^1$ is a $C_1$–$C_6$ alkyl group, n is an integer of from 2 to 4, x is an integer of from 0 to 30, $R^2$ is a linear alkenylene, hydroxyalkylene or hydroxyalkenylene group containing from 6 to 22 carbon atoms, and M is hydrogen or an alkali metal cation, preferably the sodium or potassium cation.

These wetting agents are distinguished by very good solubility in water, even in the presence of high concentrations of dissolved electrolytes, particularly in the presence of strong acids and alkalis. Accordingly, the present invention relates to the use of these ether sulfonates as wetting agents, especially in highly acidic and highly alkaline, commercial-grade treatment solutions, i.e. in solutions which have a pH-value below 3 or above 10.

The ether sulfonates used in accordance with the invention can be produced by reacting an olefinically unsaturated fatty alkyl lower alkyl ether (i.e. a compound of formula II below in which X=O), or an olefinically unsaturated fatty alkyl (polyoxyalkyl) lower alkyl ether corresponding to the following general formula $$R^1—O(C_nH_{2n}O)_x—R^3 \quad (II)$$

in which $R^1$, n and x are as defined above and $R^3$ is a mono- or di-unsaturated linear alkenyl group containing from 6 to 22 carbon atoms, with sulfur trioxide, introducing the reaction product into an aqueous solution of 1 to 1.2 moles of an alkali metal hydroxide per mole of added $SO_3$ and heating the solution to hydrolyze the sultones formed.

In addition to some unsaturated ether sulfonic acids, sultones are formed as main products in the reaction of the unsaturated fatty alkyl (polyoxyalkyl) lower alkyl ethers corresponding to general formula II with sulfur trioxide. Hydrolysis of these sultones results in the formation of the corresponding hydroxy sulfonic acids and, in some cases, even of unsaturated sulfonic acids or alkali metal salts thereof (with elimination of water). Accordingly, the ether sulfonates used in accordance with the invention are preferably mixtures of compounds corresponding to formula I in which $R^2$ represents alkenylene, hydroxyalkylene and hydroxyalkenylene groups.

The starting compounds of forumla II can be obtained by methods known from the literature. They are produced from unsaturated alcohols corresponding to the formula $R^3$—OH, where $R^3$ has the meaning given above. Where x is a number of from 1 to 30, these unsaturated alcohols are reacted by methods known from the literature with x moles of an alkylene oxide of the formula $C_nH_{2n}O$, for example with ethylene oxide or propylene oxide or with mixtures of these alkylene oxides. Mixtures of homologous alkoxylates are obtained, their average degree of alkoxylation corresponding to the quantity of the added alkylene oxide. Etherification of the terminal hydroxyl group of the unsaturated alcohols and/or their alkoxylates is also carried out by methods known from the literature. For example, it may be carried out by converting the alcohol or the alkoxylate with an alkali metal into the alcoholate and reacting the alcoholate thus formed with an alkyl halide, for example with an alkyl chloride corresponding to the forumla $R^1$—Cl. In another process, the alcohol or the alkoxylate is reacted with an alkyl halide at elevated temperature in the presence of a finely powdered alkali metal hydroxide. Finally, the alkoxylate can be reacted with an alkyl chloride or alkyl bromide corresponding to the general formula $R^1$—Cl or $R^1$—Br in the presence of an aqueous solution of NaOH or KOH in accordance with the teachings of German Pat. No. 2,800,710.

The unsaturated alcohol $R^3$—OH used above is preferably an unsaturated fatty alcohol containing from 16 to 22 carbon atoms, i.e. an alcohol from the group comprising palmitoleyl alcohol, oleyl alcohol, linoleyl alcohol, erucic alcohol, or a mixture of these alcohols, for example a commercial-grade fatty alcohol cut consisting predominantly of those alcohols. Small amounts of saturated alcohols, for example cetyl and stearyl alcohol, are tolerable, above all if the products of general formula II produced therefrom by alkoxylation and etherification are themselves soluble in water. Commercial cetyl-oleyl and oleyl-linoleyl alcohol cuts having an iodine number of from 70 to 130 are preferably used herein.

Particularly suitable wetting agents corresponding to general formala I are obtained by addition of 3 to 10 moles of ethylene oxide onto those alcohols, etherification with an alkyl halide, for example $R^1$—Cl, and sulfonation with $SO_3$. In general formula I, therefore, n is preferably 2, x is preferably an integer of from 3 to 10, and $R^2$ is an alkenylene, hydroxyalkylene or hydroxyalkenylene group containing from 16 to 22 carbon atoms.

The wetting agents used in accordance with the invention are distinguished by particularly low foam. This is of particular advantage in strongly alkaline treatment preparation, for example in alkaline cold bleach liquors, hot bleach liquors, mercerizing liquors, and alkaline scouring and degreasing agents, because alkaline treatment preparations such as these are particularly prone to foaming. This foaming may be caused either by the use of a foaming wetting agent or by the formation of vigorously foaming hydrolysis products under the surface treatment conditions, for example, the formation of soaps from hydrolyzed fats or of foaming protein degradation products from protein compounds. In alkaline treatment solutions such as these, the use of the low-foam ether sulfonates is of particular value because, on the one hand, these wetting agents do not themselves generate any foam and, on the other hand, successfully counteract the generation of foam from foaming hydrolysis products.

The treatment compositions containing the wetting agents of formula I are aqueous, strongly acid or alkaline solutions containing an acid or base in amount sufficient to produce a pH of less than 3 or more than 10 and a wetting—effective quantity of at least one wetting agent of Formula I. Generally, from 0.05 to 1% by weight, based on the weight of the treatment preparation, of a wetting agent of Formula I is employed. Acids that can be used in the treatment preparations of the invention include the mineral acids, such as sulfuric acid, hydrochloric acid, phosphoric acid, etc. Bases that can be used include alkali metal hydroxides, e.g. NaOH and KOH, $Na_2CO_3$, $K_2CO_3$, $Na_2SiO_3$, $K_2SiO_3$, etc. Other ingredients commonly used in such compositions can also be present, depending upon the use for which the composition is designed.

The use of the ether sulfonates as low-foam wetting agents in aqueous alkaline bleaching liquors is of particular interest. These bleaching liquors contain, as the bleaching agent, hydrogen peroxide or compounds which, in aqueous solution, form hydrogen peroxide. The pH-value of the bleaching baths is adjusted to 10–14 with strong bases, for example with NaOH, KOH, $Na_2CO_3$, $K_2CO_3$ and/or waterglass. Known anionic and nonionic wetting agents, which are stable and effective in that medium, tend to foam vigorously in the high-speed machines. For this reason, it is common practice to use foam suppressors, for example of the silicone oil type. By contrast, the ether sulfonates used in accordance with the invention generate hardly any foam in baths such as these, so that there is no need for antifoam agents to be added. Accordingly, the invention relates in particular to the use of the ether sulfonates corresponding to the general formula I as low-foam wetting agents in aqueous cold bleaching solutions containing from 0.3 to 3% by weight of hydrogen peroxide and from 0.05 to 1 mole/l of a strong base which is one or more of sodium hydroxide, potassium hydroxide, sodium carbonate, potassium carbonate, sodium silicate and potassium silicate, preferably in a quantity of from 0.05 to 1% by weight, based on the bleaching solution.

Bleaching solutions of the above type are used at temperatures in the range from 10° to 142° C. and preferably at a temperature of the order of 20° C. (cold bleaching).

The invention is illustrated by but by no means limited by the following examples.

EXAMPLES

1. Preparation of oleyl alcohol-5EO-butylether sulfonate Na salt 886 g (approx. 1.6 moles) of the n-butylether of an adduct of 5 moles of ethylene oxide with a commercial oleyl alcohol having an iodine number of 94 (HD-Ocenol TM 92/96) were continuously reacted at 60° C. with 187.8 g (approx. 2.35 moles) of gaseous $SO_3$ (separated from oleum) in a falling-film reactor. After leaving the reactor, the reaction product was introduced into a solution of 98 g (2.45 moles) of NaOH in 1600 g of water. The solution obtained was refluxed for 6 hours, resulting in the formation of a solution of the ether sulfonate having the following characteristics:

Active substance (dry residue): 43.0% by weight
Anionic surfactant (DGF-method H-III-10): 0.62 mval/g
$Na_2SO_4$: 2.0% by weight
Unsulfonated (DGF-method G-III-6b): 6.0% by weight

2. Cetyl/oleyl alcohol+5EO butylether sulfonate, Na salt

An ether sulfonate was produced as in Example 1 from the n-butylether of an adduct of 5 moles of ethylene oxide with a cetyl/oleyl alcohol having an iodine number of 52 (HD-Ocenol TM 50/55).

3. Cetyl/oleyl alcohol+5EO butylether sulfonate, Na salt

An ether sulfonate was produced as in Example 1 from the n-butylether of an adduct of 5 moles of ethylene oxide with an oleyl/linoleyl alcohol cut having an iodine number of 120 (HD-Ocenol TM 110/130).

4. Testing of the wetting effect of an alkaline cold bleaching solution

| Composition: | |
|---|---|
| Hydrogen peroxide (35% aqueous solution) | 35 ml |
| Soda waterglass, 38° Be | 15 ml |
| Sodium hydroxide | 12 g |
| Wetting agent (from Example 1, 2, or 3) | 4 g |
| $MgSO_4$ | 0.2 g |
| Hydroxyethane diphosphonic acid (HEDP) | 2 g |
| Deionized water | ad 1000 ml |

The wetting effect of these solutions was determined at 20° C. in accordance with DIN 53901 (determining the immersion wetting power of surfactant solutions).

The following wetting times were obtained for the cold bleaching solutions containing the wetting agents according to Examples 1 to 3:

Wetting agent of Example 1: 8 (secs.)
Wetting agent of Example 2: 8 (secs.)
Wetting agent of Example 3: 8 (secs.)

5. Testing the foaming behavior of the alkaline cold bleaching solutions according to Example 4

The foaming behavior of the cold bleaching solutions according to Example 4, which contained as wetting agents the products of Examples 1, 2 and 3 and, for comparison, 2-ethylhexyl sulfate, Na salt, a known alkali-stable wetting agent, was tested at 20° C. in an apparatus in which the solutions were pumped from a storage vessel via a pipe and a free drop of 30 cm back into the storage vessel. The recirculation of the solutions produced a surface foam of which the volume was measured after a recirculation time of 5 minutes.

The following foam values (in % of the quantity of foam of the comparison solution containing 2-ethylhexyl sulfate, Na salt, as wetting agent) were obtained for the cold bleaching solutions containing the wetting agents of Examples 1 to 3:

Wetting agent of Example 1: 40%
Wetting agent of Example 2: 0% (foam-free)
Wetting agent of Example 3: 45%

6. Further Application Examples

| | | |
|---|---|---|
| 6.1 | Alkaline scouring | |
| | Sodium hydroxide | 60 g |
| | Ether sulfonate of Example 2 | 5 g |
| | Hydroxyethane diphosphonic acid | 2 g |
| | Deionized water ad | 1000 ml |
| 6.2 | Mercerizing liquor | |
| | Sodium hydroxide | 300 g |
| | Ether sulfonate of Example 1 | 6 g |
| | Deionized water ad | 1000 ml |
| 6.3 | Carbonizing solution (for the hank and full-width carbonizing of wool) | |
| | Conc. sulfuric acid | 40 g |
| | Ether sulfonate of Example 2 | 5 g |

-continued

| | |
|---|---|
| Deionized water ad | 1000 ml |

What is claimed is:

1. In an aqueous composition for the treatment of a solid surface wherein such composition has a pH below 3 or above 10 and wherein such composition contains a wetting agent, the improvement wherein said wetting agent is an effective amount of an ether sulfonate of the formula $$R^1—O(C_nH_{2n}O)x—R^2—SO_3M \quad (I)$$

in which $R_1$ is a $C_1$–$C_6$ alkyl group, n is an integer of from 2 to 4, x is an integer of from 0 to 30, $R_2$ is a $C_6$–$C_{22}$ linear alkenylene, hydroxyalkylene, or hydroxyalkenylene group, and M is hydrogen or an alkali metal cation.

2. A composition in accordance with claim 1 wherein from about 0.05 to about 1% by weight, based on the weight of the composition, of the ether sulfonate of formula I is present in the composition.

3. A composition in accordance with claim 1 wherein in the ether sulfonate of formula I, n is 2, x is 3–10, and the $R^2$ group contains from 16 to 22 carbon atoms.

4. A composition in accordance with claim 1 wherein the composition is an alkaline peroxide bleaching bath comprising (a) from about 0.3 to about 3% by weight of hydrogen peroxide,
(b) from 0.05 to 1 mole/liter of a strong base, and
(c) from about 0.05 to about 1% by weight of the ether sulfonate of formula I.

5. A composition in accordance with claim 4 wherein in (b) the strong base is one or more of NaOH, KOH, $Na_2CO_3$, $K_2CO_3$, $Na_2SiO_3$, and $K_2SiO_3$.

* * * * *